US006491049B1

(12) United States Patent
Tuller et al.

(10) Patent No.: US 6,491,049 B1
(45) Date of Patent: Dec. 10, 2002

(54) LID CONSTRUCTION FOR DRAWER DISHWASHER

(75) Inventors: Barry E. Tuller, Humboldt, TN (US); Rodney M. Welch, Jackson, TN (US)

(73) Assignee: Maytag Corporation, Newton, IA (US)

( * ) Notice: Subject to any disclaimer, the term of this patent is extended or adjusted under 35 U.S.C. 154(b) by 199 days.

(21) Appl. No.: 09/643,600

(22) Filed: Aug. 22, 2000

Related U.S. Application Data

(63) Continuation-in-part of application No. 09/157,461, filed on Sep. 21, 1998, now Pat. No. 6,260,565.

(51) Int. Cl.[7] ..... B08B 3/00

(52) U.S. Cl. ..... 134/200; 134/85; 134/89; 134/91; 134/115 R; 134/176; 134/177; 134/179

(58) Field of Search ..... 134/56 D, 57 D, 134/58 D, 84–92, 115 R, 115 G, 176–179, 200; 239/228, 237, 330.1

(56) References Cited

U.S. PATENT DOCUMENTS

| | | | | |
|---|---|---|---|---|
| 2,024,952 A | | 12/1935 | Snyder et al. | |
| 2,380,604 A | | 7/1945 | Melton | |
| 2,704,082 A | | 3/1955 | Jackson | |
| 3,217,721 A | | 11/1965 | Hertel | |
| 3,230,961 A | | 1/1966 | Benkert et al. | |
| 3,288,154 A | | 11/1966 | Jacobs | |
| 3,586,011 A | | 6/1971 | Mazza | |
| 3,718,149 A | | 2/1973 | Mazza | |
| 3,910,499 A | | 10/1975 | Trouilhet | |
| 4,146,405 A | | 3/1979 | Timmer et al. | |
| 4,179,307 A | | 12/1979 | Cau et al. | |
| 5,017,852 A | | 5/1991 | Nagata et al. | |
| 5,046,517 A | | 9/1991 | Maruyama et al. | |
| 5,178,172 A | * | 1/1993 | Morley | 134/115 R |
| 5,184,635 A | | 2/1993 | Troomblee et al. | |
| 5,331,986 A | | 7/1994 | Lim et al. | |
| 5,470,142 A | | 11/1995 | Sargeant et al. | |
| 5,617,885 A | | 4/1997 | Centis | |
| 5,642,742 A | | 7/1997 | Noren et al. | |
| 5,651,380 A | | 7/1997 | Sargeant et al. | |
| 5,651,382 A | | 7/1997 | Sargeant et al. | |
| 5,660,193 A | | 8/1997 | Archer et al. | |
| 5,709,237 A | | 1/1998 | Sargeant et al. | |
| 5,743,281 A | | 4/1998 | Sargeant et al. | |
| 5,755,244 A | | 5/1998 | Sargeant et al. | |
| 5,762,080 A | | 6/1998 | Edwards et al. | |
| D400,320 S | | 10/1998 | Brace | |
| 5,829,459 A | | 11/1998 | Milocco et al. | |
| 5,934,298 A | * | 8/1999 | Singh | 134/115 R |
| 6,189,551 B1 | * | 2/2001 | Sargeant et al. | 134/200 |
| 6,244,277 B1 | * | 6/2001 | Mansell | 134/60 |
| 6,294,767 B1 | * | 9/2001 | Sargeant et al. | 219/481 |

FOREIGN PATENT DOCUMENTS

| | | | |
|---|---|---|---|
| EP | 0486314 | * | 5/1992 |
| EP | 0 585 905 A | | 3/1994 |
| FR | 1 500 537 A | | 1/1968 |
| FR | 2 640 487 A | | 6/1990 |
| NZ | WO-9312706 | * | 7/1993 |

* cited by examiner

*Primary Examiner*—Randy Gulakowski
*Assistant Examiner*—Joseph Perrin
(74) *Attorney, Agent, or Firm*—McKee, Voorhees & Sease, P.L.C.

(57) ABSTRACT

A drawer dishwasher includes a drawer which is movable from a closed to an open position. A lid is separate from the drawer and is adapted to seal over the top of the drawer when the drawer is in its closed position and to move upwardly and away from the drawer in response to movement of the drawer from its closed to its open position. Recirculation plumbing and draining plumbing are connected to the drawer dishwasher and lead to a remote pump and reservoir for receiving drained fluid from the drawer and for recirculating drained fluid back into the spray assembly within the drawer.

15 Claims, 9 Drawing Sheets

LID CONSTRUCTION FOR DRAWER DISHWASHER

CROSS-REFERENCE TO RELATED APPLICATION

This is a continuation-in-part application of co-pending application Ser. No. 09/157,461 filed Sep. 21, 1998, U.S. Pat. No. 6,260,565 entitled Double Dishwasher.

BACKGROUND OF THE INVENTION

This invention relates to a lid construction for a drawer dishwasher.

Various attempts have been made to provide a dishwasher which operates as a drawer and can slide in and out from beneath a countertop. Several problems are encountered in attempting to develop such a drawer dishwasher.

One problem is the necessity for connecting the various plumbing fixtures to the drawer so that the fixtures can move in unison with the drawer as it slides from its closed to its opened position. In the prior art flexible hoses are used to move with the drawer as it moves in and out.

Another problem encountered with drawer dishwashers is the ability to place a spray head within the drawer while at the same time connecting the spray head to the proper plumbing leading to a recirculation pump.

Another problem encountered with drawer dishwashers is the ability to maximize the space of the drawer without using a substantial portion of that space for a recirculation reservoir and pump.

Therefore, a primary object of the present invention is the provision of an improved lid construction for a drawer dishwasher.

A further object of the present invention is the provision of an improved lid construction which separates from the drawer when the drawer is pulled from its closed to its open position.

A further object of the present invention is the provision of an improved lid construction which cams upwardly away from sealed engagement with the top of the drawer in response to the drawer moving from its closed to its open position.

A further object of the present invention is the provision of an improved lid construction which includes a rotatable spray arm attached to the lid construction.

A further object of the present invention is the provision of an improved drawer dishwasher construction which includes a recirculation conduit attached to the lid, but detached to the drawer.

A further object of the present invention is the provision of an improved drain system which will drain fluid from the drawer throughout movement of the drawer between its closed and its open position.

A further object of the present invention is the provision of an improved drawer dishwasher which includes a recirculation reservoir located remote from the drawer and being in fluid communication with a recirculation pump for receiving the fluid from the drawer and for recirculating fluid back to the drawer through the spray arms.

A further object of the present invention is the provision of an improved drawer construction which is economical to manufacturer, durable in use and efficient in operation.

SUMMARY OF THE INVENTION

The foregoing objects may be achieved by a dishwasher having a frame assembly with forward and rear ends. A drawer having a bottom wall, a front wall, a rear wall and side walls defines a drawer compartment. The front, rear and side walls each have upper edges forming an upwardly presented opening in the drawer compartment. A lid is shaped in covering relation over the upwardly presented opening in the drawer compartment. A guide mechanism mounts the drawer to the frame for movement from a closed position wherein the lid is in covering relation over the upwardly presented opening of the drawer to an open position wherein the drawer is spaced apart from the lid. A spray assembly is positioned within the drawer compartment for spraying a washing fluid on objects within the drawer compartment whenever the drawer is in its closed position.

One feature of the improved dishwasher of the present invention is the use of a washing conduit connected to the lid when the drawer is in either of the open or closed positions, and connected to the spray assembly whenever the drawer is in its closed position.

Another feature of the present invention is a first portion of the spray assembly being attached to the interior of the lid and a second portion of the spray assembly being attached to the drawer.

Another feature of the present invention is the provision of a lid mounting mechanism mounting the lid to the frame for movement from a lowered position when the drawer is in its closed position to an upper position above the lowered position in response to the drawer moving from its closed to its open position.

Another feature of the present invention is the provision of a dishwasher wherein the drawer includes a portion which engages the lid and moves the lid to its lowered position whenever the drawer moves from its open to its closed position.

Another feature of the present invention is the provision of a drain conduit which is stationary relative to the drawer and which is adapted to receive drained washing fluid from the drawer as the drawer moves between its open and its closed positions.

An alternate embodiment of the present invention utilizes a unique gasket to seal the washing conduit within the drawer to the conduit supplying washing fluid to the drawer when the drawer is in its closed position.

Another alternate embodiment utilizes a shroud surrounding the lid to provide a vapor barrier between the drawer and the remainder of the dishwasher.

Another alternate embodiment utilizes a stationary lid in combination with an inflatable seal between the drawer and the lid.

DETAILED DESCRIPTION OF THE PREFERRED EMBODIMENT

Figure 5:
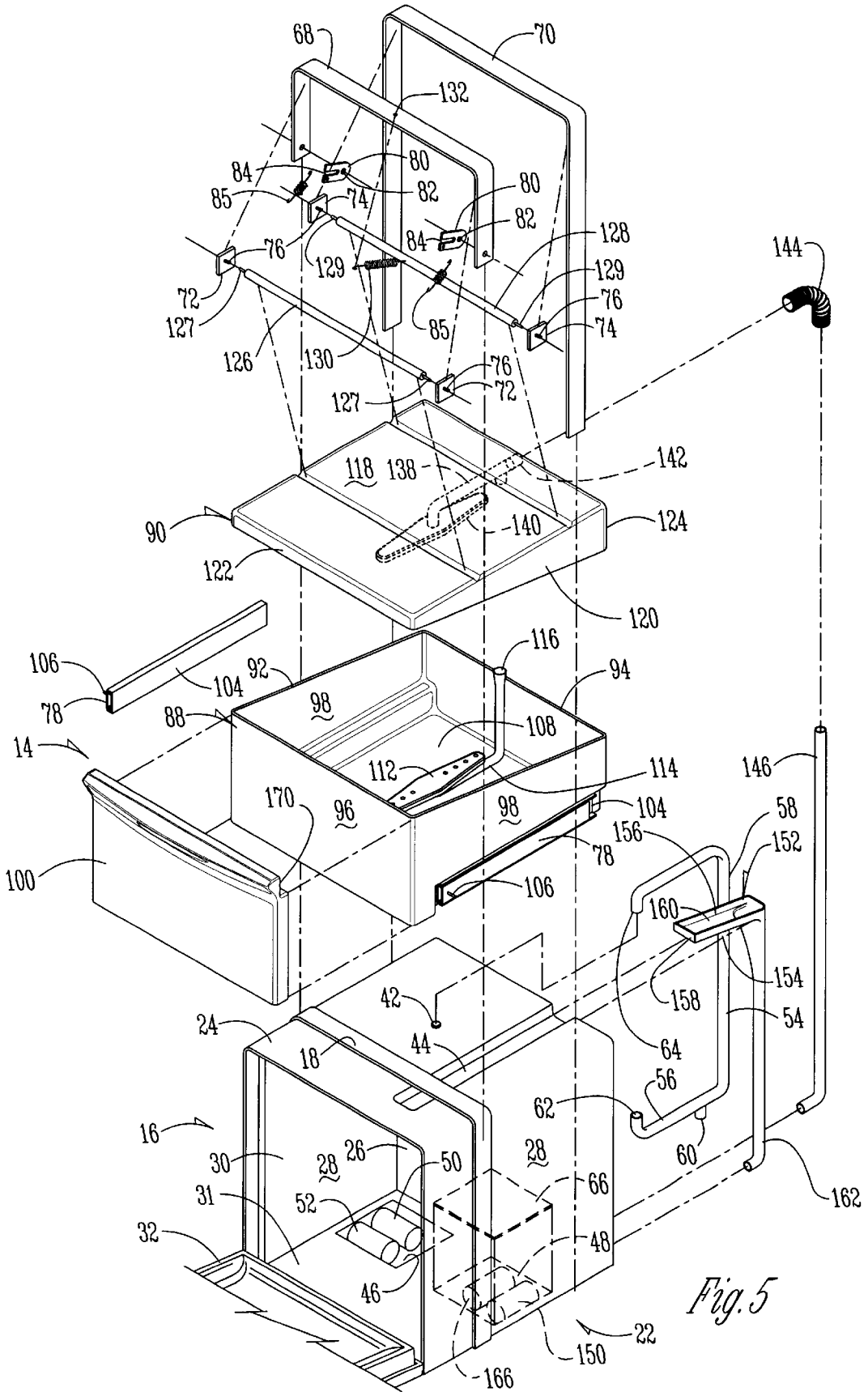
FIG. 5 is an exploded perspective view of the dual dishwasher assembly.

The numeral 10 generally designates a dual dishwasher of the present invention which is installed beneath a countertop 12. Dual dishwasher 10 includes an upper drawer dishwasher 14 and a lower swinging door dishwasher 16. A front U-shaped frame or support 18 is fitted over a lower housing or tub 22 as can be seen in FIG. 5. Tub 22 includes a top wall 24, a rear wall 26, side walls 28, a front opening 30, and a bottom wall 31. A door 32 is hinged at hinge 34 for gaining access to the interior of the lower housing or tub 22.

Within lower housing or tub 22 are an upper spray arm 36 and a lower spray arm 38, as well as an upstanding spray tower 40, all of which are of prior art construction.

On the exterior surface of top wall 24, in this embodiment, is formed a groove 44 for receiving drain channel 156 of drain conduit 152. Also, an upper spray connection 42 extends upwardly from the top wall 24 and is connected to the upper spray arm 36 for delivering fluid to the spray arm 36.

Figure 4:
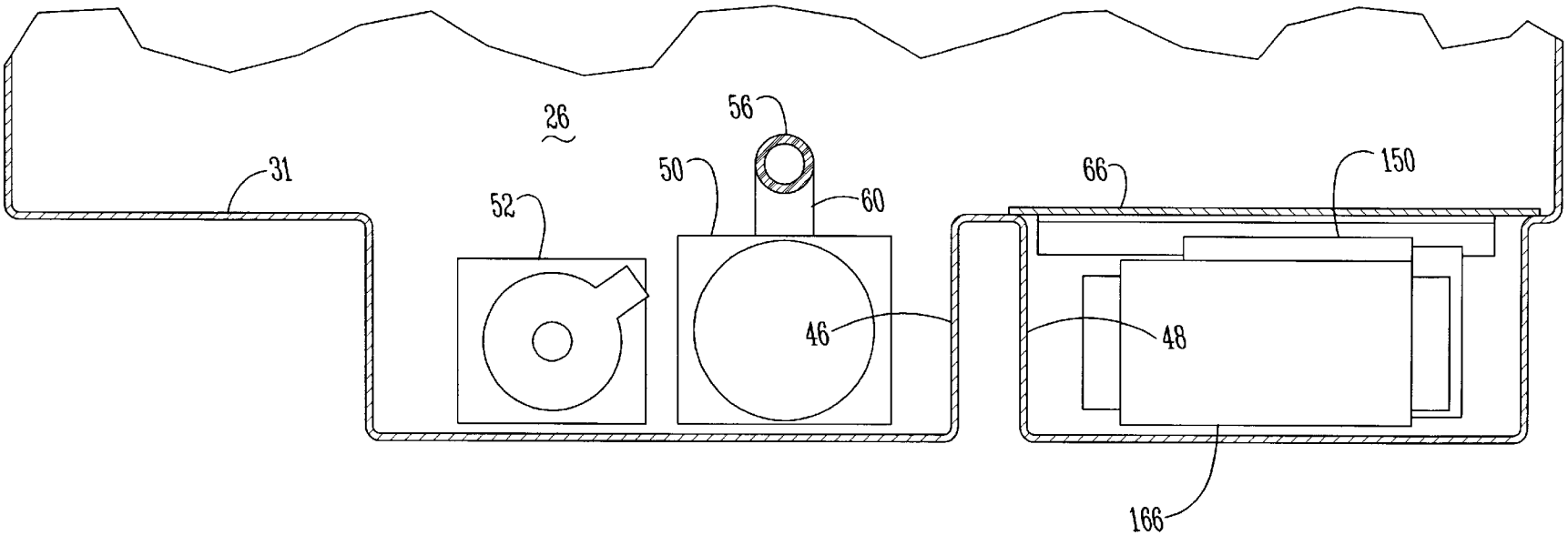
FIG. 4 is sectional view taken along line 4—4 of FIG. 2.

The bottom wall 31 of the lower dishwasher 16 includes a lower dishwasher reservoir 46 and an upper dishwasher reservoir 48 (FIG. 4). These two reservoirs are shown located in the bottom wall 31 of the lower dishwasher 16. However, it is possible to position both of these reservoirs below and outside the bottom dishwasher 16 or as an alternative the lower reservoir 46 can be placed in the bottom wall 31 as shown with the upper reservoir 48 being contained within a separate container located preferably below the lower dishwasher 16, but in any event remote from the drawer dishwasher 14. The reservoirs 46 and 48 are separately and selectively filled with fresh wash water from an external source. The remote and separate reservoirs 46 and 48 permit water fills to take place separately and also allows the water to be externally heated in preparation for a cycle which significantly reduces the total cycle time.

Within lower dishwasher reservoir 46 are a lower washer pump 50 and a lower drain pump 52. Drain pump 52 is adapted to pump fluid within reservoir 46 outwardly to a drain through conduits (not shown). Alternately, a drain valve arrangement can be utilized to accomplish draining of reservoir 46.

The lower wash pump 50 is connected to a lower wash conduit 54 having a lower end 56 and an upper end 58. Adjacent the lower end 56 is a pump connection 60 which is adapted to connect to lower wash pump 50. Similarly a spray connector 62 is adapted to be connected to the lower spray arm 38 and spray tower 40. Adjacent the upper end 58 of lower wash conduit 54 is an upper spray connection 64 which is adapted to connect to the upper spray connection 42 at the top of the lower dishwasher 16. In this embodiment, a lid or top panel 66 is sealed in covering relation over the top of upper reservoir 48 so as to isolate lower reservoir 48 from the remainder of the interior of the dishwasher 16.

A forward upper U-shaped frame or support 68 is attached to the upper ends of U-shaped frame 18. A rear U-shaped frame or support 70 embraces lower tube 22 and extends upwardly therefrom. Attached to the interior surfaces of the legs of U-shaped frames 68, 70 are front cam plates 72 and rear cam plates 74 respectively. Each of the cam plates 72, 74 include an angled cam slot 76 therein.

A pair of closing toggles 80 are pivotally connected to the forward U-shaped frame 68 for pivotal movement about axis 82. Each closing toggle includes a slot 84 therein and each closing toggle is spring mounted by a spring 85 so as to cause the closing toggles to be urged forwardly with their U-shaped slot extending forwardly in the position shown in FIG. 7*c*.

Figure 3:
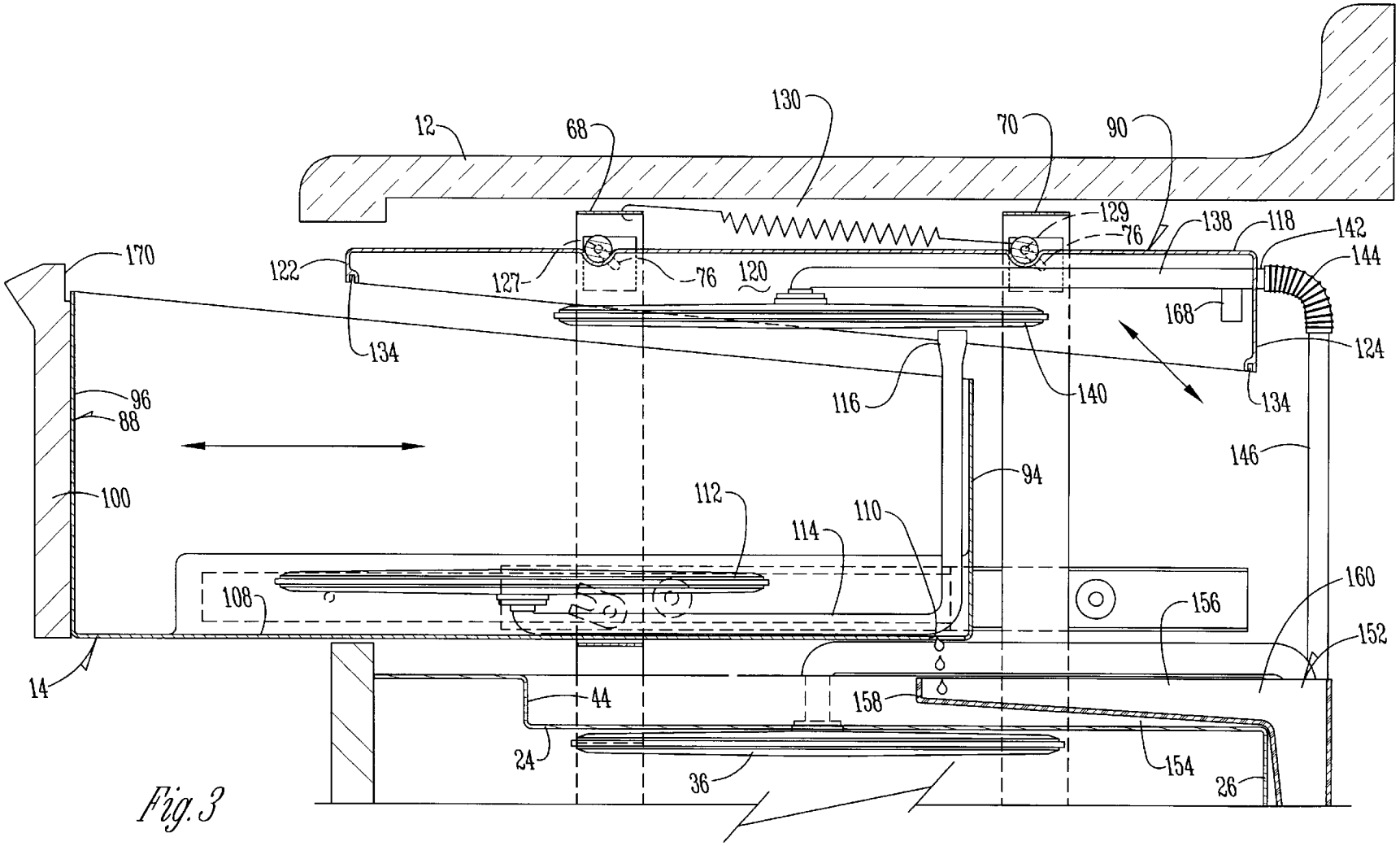
FIG. 3 is a partial sectional view of the upper portion of FIG. 1, showing the upper drawer dishwasher compartment in a partially open position.

A drawer 88 and a lid 90 comprise the upper drawer dishwasher 14. Drawer 88 includes a rear wall 94, a front wall 96, side walls 98 and a bottom wall 108 which form an upper dishwasher chamber 92 having an open upper end. A front panel 100 is attached to the front wall 96 of the drawer 88 and may contain the operation controls for both dishwashers. A pair of guide tracks 104 are mounted to the side walls 98 of drawer 88 and are adapted to cooperate with drawer frames 68, 70 so as to permit the drawer 88 to glide from a closed position shown in FIG. 1 to an open position wherein a substantial portion of the open upper end of the drawer 88 is exposed outside the dishwasher 10. FIG. 3 shows the drawer 88 in a partially open position.

Figure 7A:
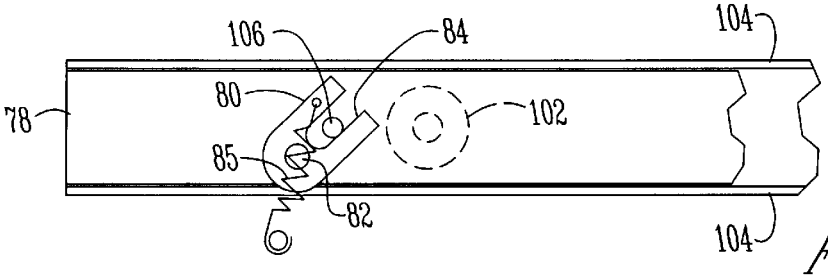
FIGS. 7*a, b,* and *c* are detailed elevational views showing the closing mechanism for the drawer assembly of the present invention in its closed, intermediate, and open position respectively.
Figure 7B:
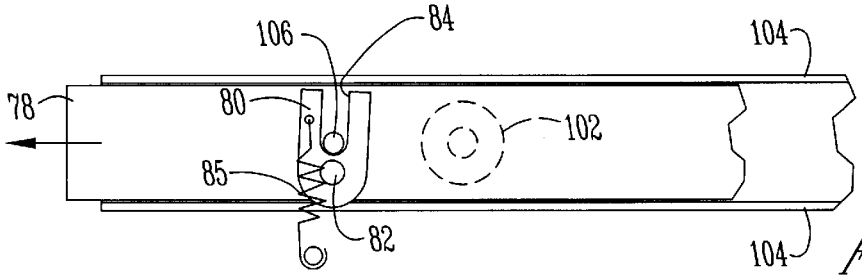
Figure 7C:
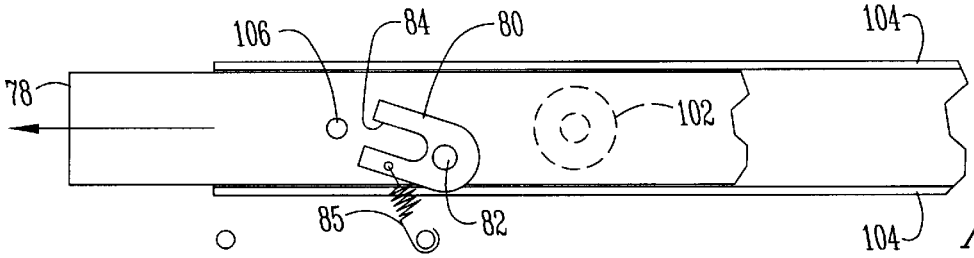

Closing pins 106 protrude outwardly from the sides of guide tracks 104 and are adapted to engage the U-shaped slots 84 of closing toggles 80 in the manner shown in FIGS. 7*a*, 7*b* and 7*c*. FIG. 7A shows the drawer in its closed position with the toggle 80 having its slot 84 presented rearwardly with the spring 85 yieldably urging the toggle 80 in a counterclockwise direction.

FIG. 7B shows the toggle 80 in an over center position during the opening of drawer 88.

FIG. 7C shows the drawer in a further opened position. With the toggle 80 in a forwardly presented position and with the pin 106 removed from the slot 84.

During closing of the drawer a reverse motion is obtained with the pin 106 extending into the slot 84 initially and rotating the toggle 80 to its over-center position shown in FIG. 7B. Finally the closing of the drawer causes the toggle 80 to move over center and face rearwardly as shown in FIG. 7A. This provides a solid affirmative closing action to the drawer as it is closed.

Drawer 88 includes a bottom wall 108 having a drain opening 110 therein. Also within the drawer 88 is a lower spray arm 112 which is connected to a conduit 114 which has an upper tapered end 116 shaped somewhat like a funnel.

Lid 90 includes a lid top wall 118, side walls 120, a front wall 122 and a rear wall 124. Lid 90 is wedge shaped with the rear wall 124 having a greater vertical height than the front wall 122. The top edges of drawer 88 are inclined in the opposite direction.

Fixed to the upper surface of the top wall 118 are a front pin rod 126, having front pins 127 extending from its opposite ends thereof and a rear pin rod 128 having rear pins 129 extending from the opposite ends thereof. A spring 130 is connected at one end to rear pin rod 128 and is connected at the forward end to a spring receiving hole 132 in the front U-shaped frame 68. The spring 130 urges the lid forwardly and upwardly.

Figure 2:
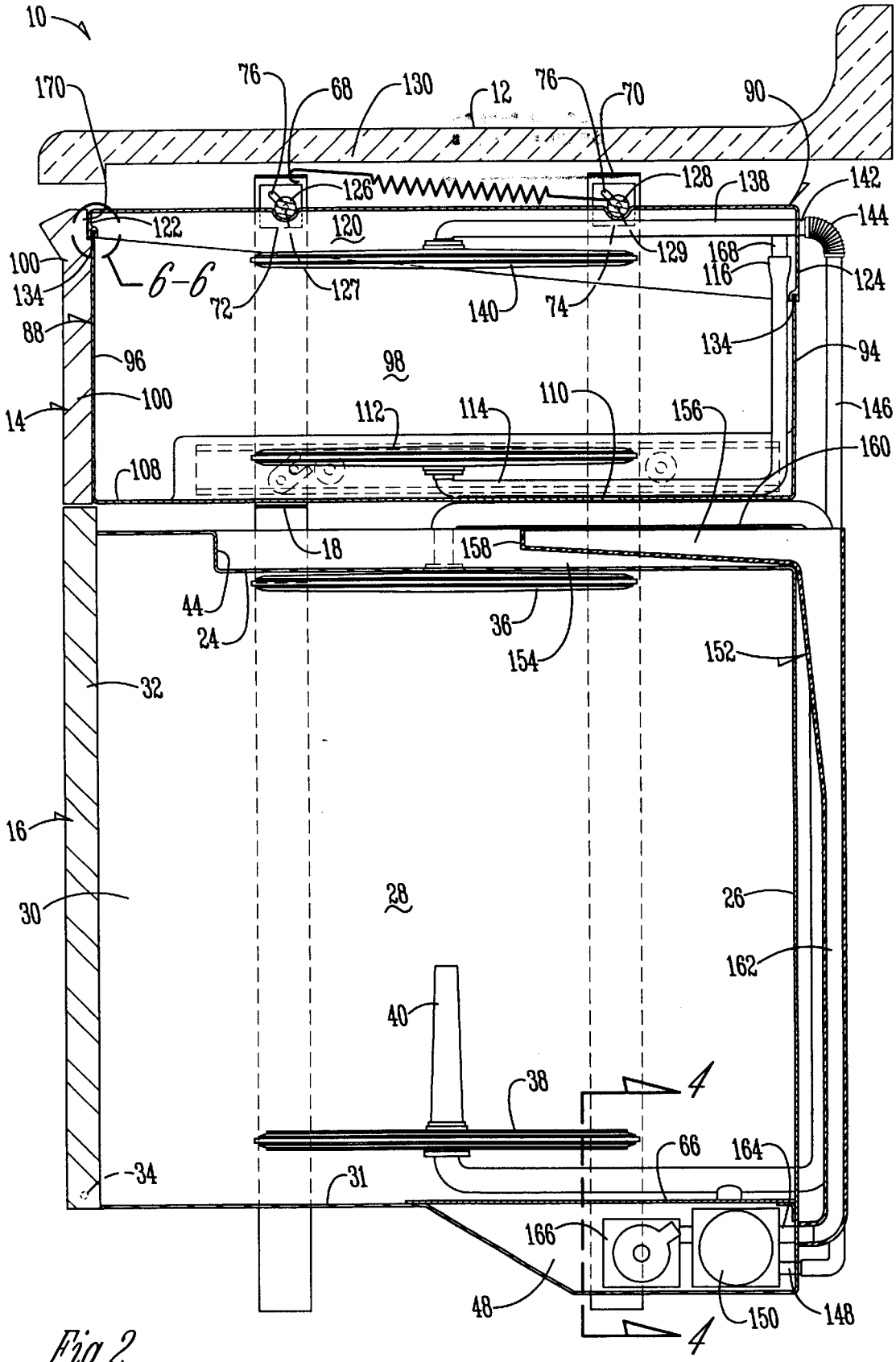
FIG. 2 is a sectional view of the dual dishwasher assembly of the present invention taken along line 2—2 of FIG. 1.
Figure 6:
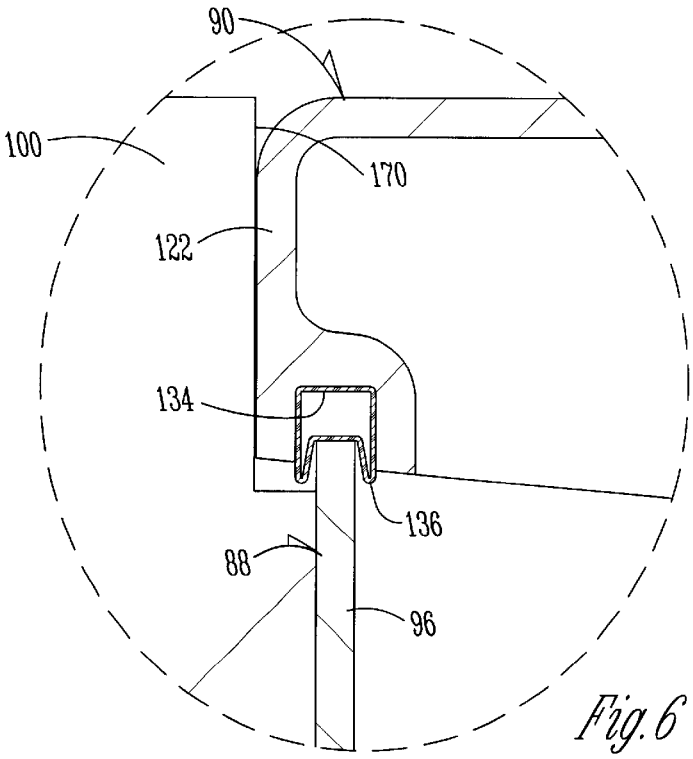
FIG. 6 is an enlarged sectional view taken along line 5—5 of FIG. 1.

The lower edges of front wall 122, side walls 120 and rear wall 124 of lid 90 are all provided with U-shaped slots 134 which are provided with sealing gasket 136 and which fit over the upper edges of the drawer 88 in the manner shown in FIGS. 2 and 6.

Attached to the lid 90 on the under surface thereof is an upper spray conduit 138 which feeds a rotatable upper spray arm 140 for spraying the dishes or other objects within the drawer 88. Spray conduit 138 includes a rear end 142 which protrudes from the rear wall 124 of lid 90 and which is attached to a flexible coupling 144. Coupling 144 is in turn connected to the upper end of a washing conduit 146 which extends downwardly behind the two dishwashers 14, 16 and is attached to a pump conduit 148 which extends through the rear wall 26 of lower dishwasher 16 and connects to a washing pump 150 which is located within the upper reservoir 48.

Figure 1:
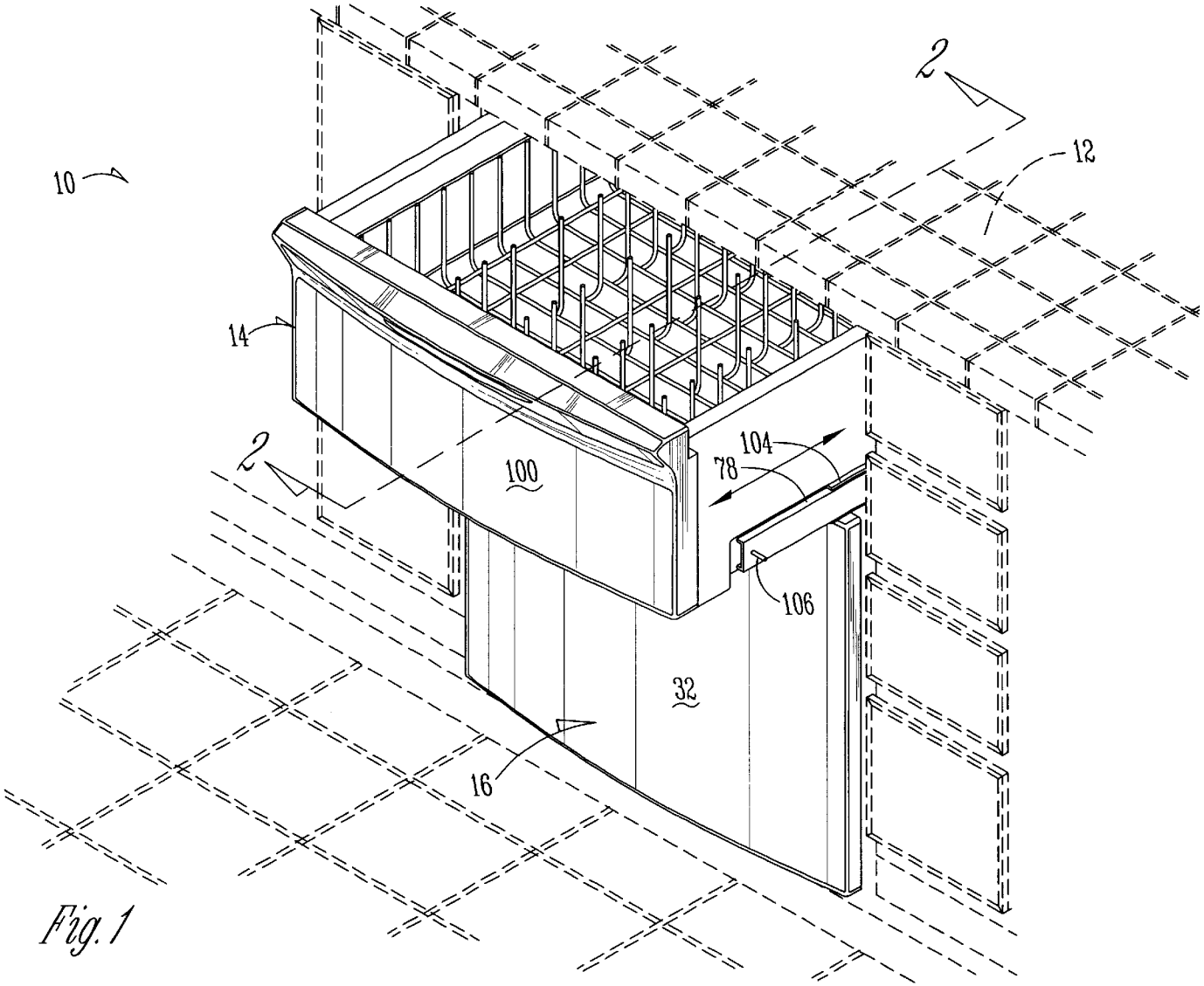
FIG. 1 is a perspective view of the dual dishwasher of the present invention.

A drain conduit 152 includes an upper horizontal leg 154 having a drain channel 156 formed therein. Drain channel 156 includes a closed end 158 and an open top 160 and is positioned in registered alignment below the drain opening 110 of drawer 88 when the drawer 88 is in its closed position as shown in FIG. 1. Also, the drain channel 156 is fitted within the groove 44 in the upper surface of lower dishwasher 16. Alternatively, the drain channel 156 could overlie the top wall 24 and groove 44 would not be required. Drain conduit 152 includes a downwardly extending vertical leg 162 which is connected to a drain tube 164 extending into the reservoir 48 in the bottom dishwasher 16. A drain pump 166 is also located within the reservoir 48 and is connected to a drain for causing the emptying and draining of any washing fluid within the reservoir 48 after the washing cycle is complete.

As can be seen in FIG. 2, the pins 127, 129 of the lid 90 are fitted within the cam slots 76 of the front and rear cam plates 72, 74.

When the drawer is in its closed position shown in FIG. 2, the pins 127, 129 are located in the lower rear ends of slots 76, and the lid 90 is fitted in sealing relationship over the top edges of the rear wall 94, the side walls 98 and the front wall 96 of drawer 88. This provides an enclosed washing chamber for washing objects within the upper drawer dishwasher 14.

In the closed position shown in FIG. 2 the upper tapered end 116 of conduit 114 is in sealed engagement with a downwardly presented connection 168 of upper spray conduit 138 so as to receive pressurized washing fluid from washing pump 150. The washing fluid moves upwardly through washing conduit 146 and through conduit 138 to provide pressurized fluid for wash arms 112 and 140. The fluid being sprayed from washing arms 112 and 140 drains downwardly by gravity through drain 110 into drain conduit 152 which returns the washing fluid downwardly into upper dishwasher reservoir 48. The pump 150 then receives that fluid and recirculates it upwardly to the wash arms 112 and 140.

After the washing operation when it is desired to open drawer 88, the operator pulls the drawer 88 outwardly. FIG. 3 illustrates the position of the drawer 88 in a partially opened position. During the initial movement, the lid 90 and the drawer 88 are assembled together, and the initial outward motion of the drawer 88 causes the lid 90 also to be moved forwardly. However, the location of the pins 127, 129 of lid 90 in the cam slots 76 cause the motion of the lid 90 to be translated upwardly also so that the lid 90 separates from its sealed engagement with the upper edges of the drawer 88. Spring 130 facilitates this upward and outward movement of lid 90 and holds the lid 90 in its upward and outward position shown in FIG. 3. Similarly the downwardly presented connection 168 of upper spring conduit 138 separates and moves upwardly from the upper tapered end 116 of conduit 114. The flexible coupling 144 permits limited movement between the conduit 146 and the lid 90.

During the opening of drawer 88, residual fluid within the drawer 88 may possibly drain from drain 110. If this happens, the fluid still enters the drain channel 156 and drains downwardly to the reservoir 48.

When the drawer 88 is again closed, the upper edge 170 of front panel 100 engages the front wall 122 of lid 90 and urges the lid 90 in a rearward direction. The cam slots 76 cause the lid 90 to move downwardly as it is moving rearwardly, and once the drawer 88 is in its closed position shown in FIG. 2 the lid 90 is again in sealing engagement over the top edges of the drawer 88. Also, the downwardly presented connection 168 is sealed and in engagement with the upper tapered end 116 of conduit 114.

The foregoing arrangement provides several advantages. First the fluid reservoir 48 for the upper dishwasher 14 is positioned downwardly below the bottom dishwasher 16 and minimizes the space occupied. This maximizes the space available for the two dishwashers 14, 16. While the reservoir 48 is shown as being part of the bottom dishwasher 16 it can be positioned remotely from dishwasher 16 and preferably below the dishwasher 16.

The use of a lid 90 which is separate from the drawer 88 provides means for connecting the recirculation conduits to the lid rather than to the drawer, thereby eliminating the need of flexible hoses which need to follow the drawer as it moves to its open position. The cam slots 76 provide means for raising and lowering the lid a limited distance thereby minimizing the movement between the lid 90 and the conduit 146. This slight movement can be easily accommodated by the flexible coupling 144.

Figure 8:
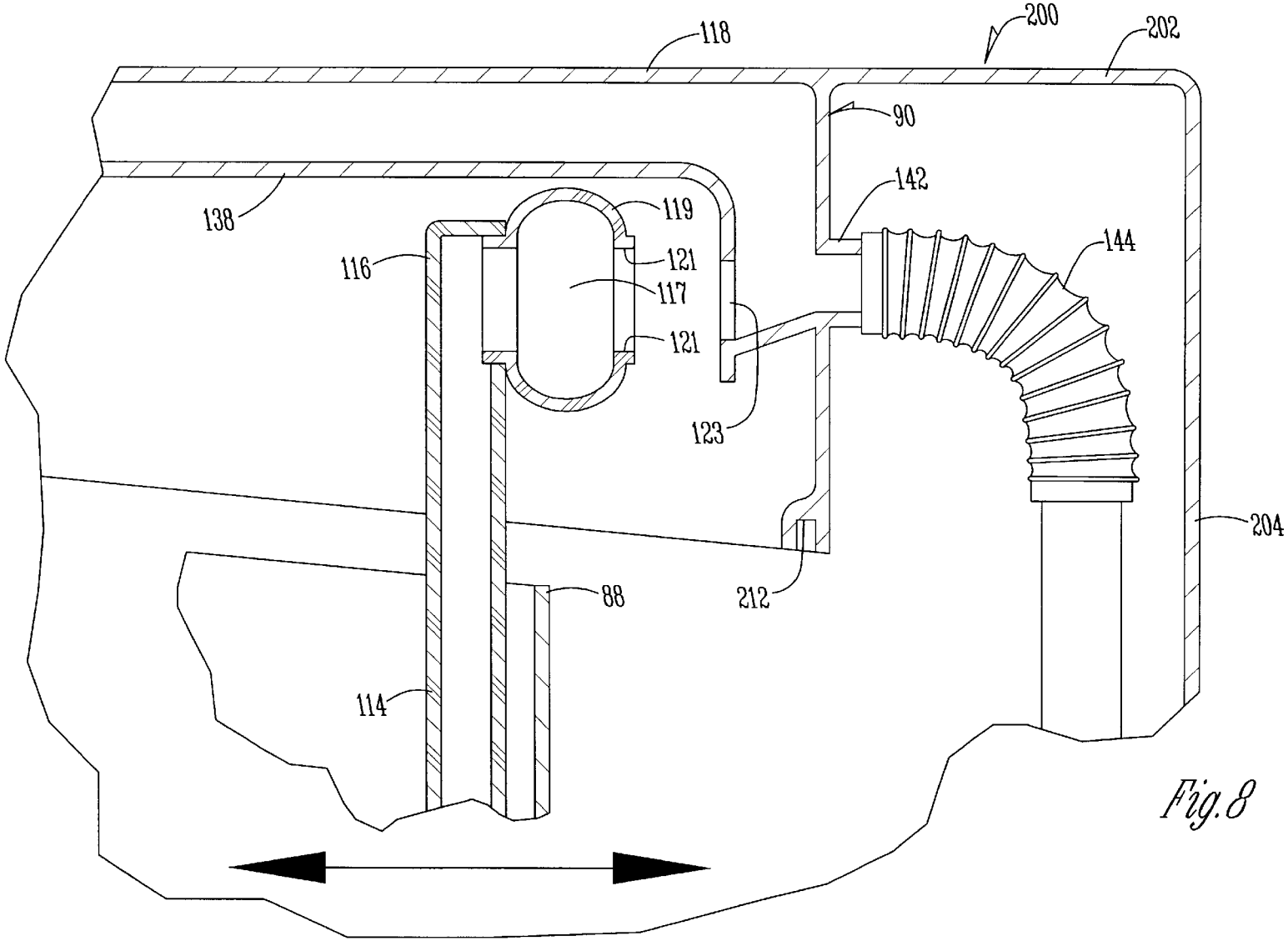
FIG. 8 is an enlarged sectional detail of a modified form for the conduit connections at the rear of the upper drawer assembly.

FIG. 8 shows a modified embodiment of the rear conduit construction at the back of drawer 88. Upper end 116 of conduit 114 is shown in FIG. 8 to have a rearwardly facing opening 117 surrounded by a flexible gasket 119 having lips 121.

Upper spray conduit 138 includes a rearwardly presented water aperture 123 which is engaged and sealed by gasket 119 when drawer 88 is closed. The vertical movement of the lid 90 in this embodiment is very slight, and gasket 119 compensates for what slight movement occurs.

When the drawer 88 moves to its rear position gasket 119 seals around water aperture 123 so that washing fluid will be introduced to conduit 114.

Figure 9:
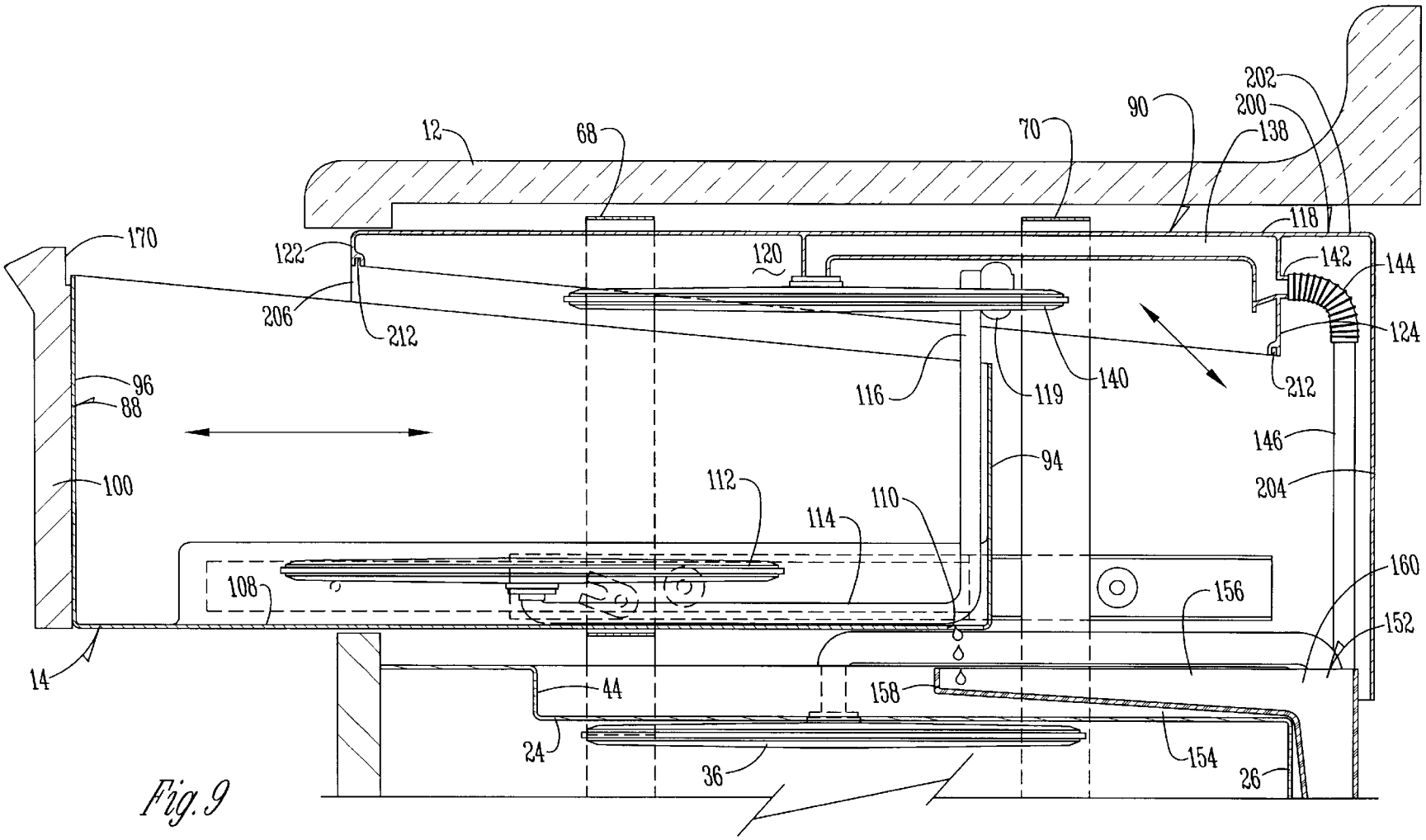
FIG. 9 is an enlarged sectional view of an alternate embodiment of the present invention.
Figure 10:
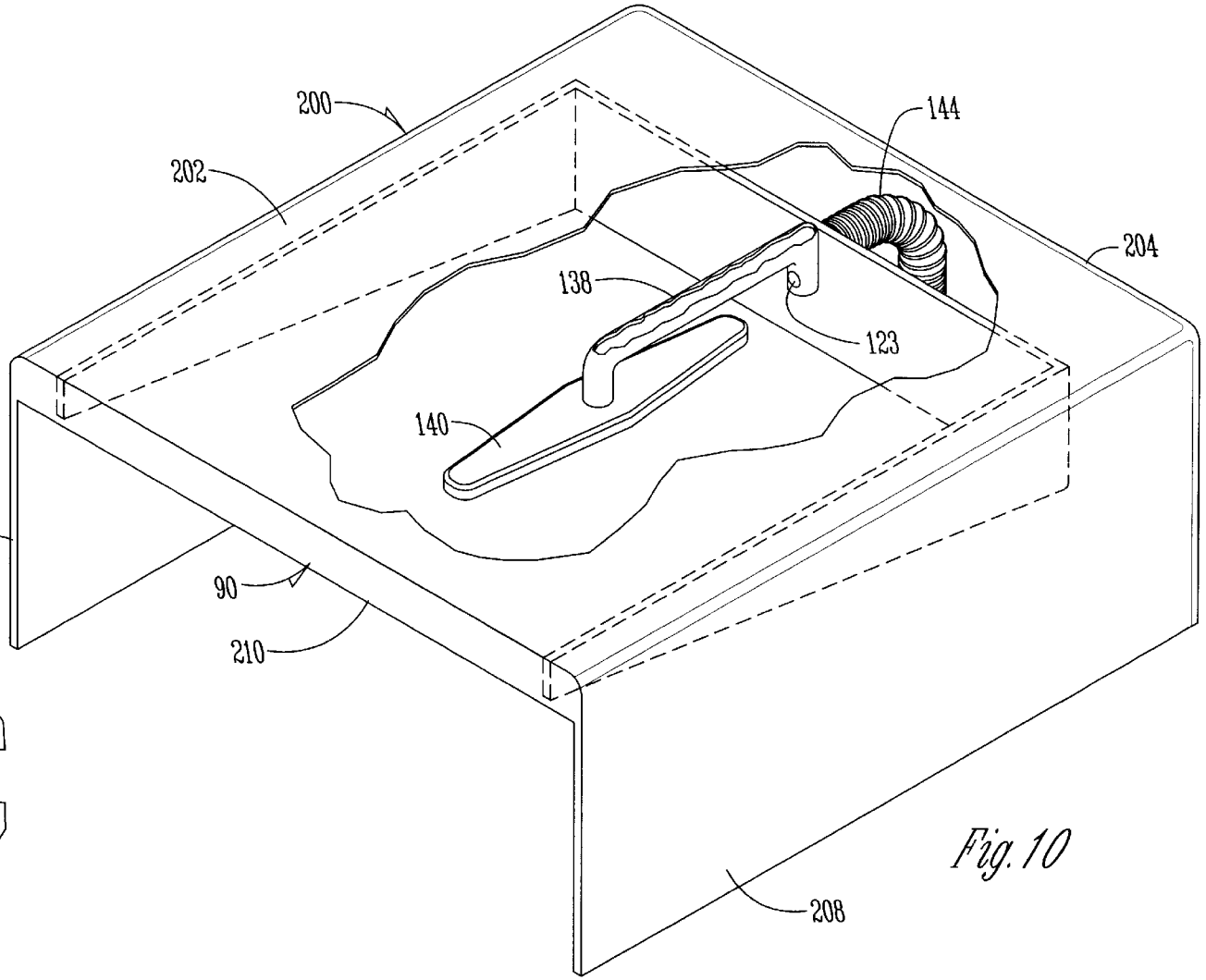
FIG. 10 is a partially broken away perspective view of an alternate embodiment of the present invention utilizing a shroud around the lid.
Figure 11:
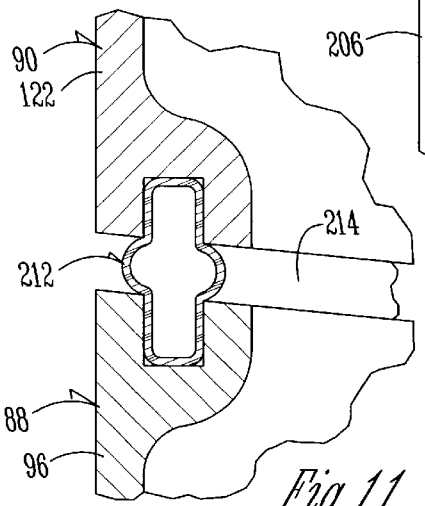
FIG. 11 is an enlarged sectional view of an alternate embodiment of the present invention utilizing an inflatable seal between the drawer and the lid.

Referring to FIGS. 9, 10, and 11 a modified form of the invention includes a shroud 200 which is preferably molded integrally with lid 90 and which includes a top wall 202, a rear wall 204, opposite side walls 206, 208, and a front wall 210.

The shroud 200 and the lid 90 are stationary. An inflatable seal 212 provide a satisfactory seal between the lid 90 and the drawer 80, an inflatable seal 212 (FIG. 11) may be attached either to the drawer 88 or alternatively to the lid 90. When the drawer is closed there is a slight clearance 214 between the lid 90 and the drawer 88. Inflation of seal 212 causes it to expand and form a fluid tight seal between lid 90 and drawer 88.

In the embodiment of FIGS. 9, 10, and 11 the sealing gasket 119 at the upper end 116 of spray conduit 114 shown in FIG. 8 is used and operates in the same manner as described for FIG. 8.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention ask further defined in the following claims.

What is claimed is:

1. A dishwasher comprising:

a support assembly;

a drawer having bottom, front, rear, and side walls defining a drawer compartment, said front, rear, and side walls having upper edges forming an upwardly presented opening in said drawer compartment;

a lid shaped to fit in covering relation over said upwardly presented opening of said drawer compartment;

a guide mechanism mounting said drawer to said support assembly for movement from a closed position wherein said lid is in covering relation over said upwardly presented opening to an open position wherein said drawer is spaced apart from said lid;

a spray assembly comprising a first sprayer and a second sprayer positioned within said drawer compartment for spraying a washing fluid on objects within said drawer compartment when said drawer is in said closed position; and a washing conduit connected to said lid when said drawer is in either of said open or closed positions, said washing conduit being free from fluid connection with said second sprayer when said drawer is in said open position and being in fluid connection with said second sprayer when said drawer is in said closed position for delivering said washing fluid to said second sprayer.

2. A dishwasher according to claim 1, wherein a first portion of said spray assembly is attached to said lid.

3. A dishwasher according to claim 2, wherein a second portion of said spray assembly is attached to said drawer, said washing conduit being connected to both of said first and second portions of said spray assembly when said drawer is in said closed position.

4. A dishwasher according to claim 1, and further comprising a lid mounting mechanism mounting said lid to said support assembly for movement from a lowered position when said drawer is in said closed position, to an upper position above said lowered position in response to said drawer moving from said closed position to said open position.

5. A dishwasher according to claim 4, wherein said drawer includes a portion which engages said lid and moves said lid to said lowered position whenever said drawer moves from said open to said closed position.

6. A dishwasher comprising:

a frame assembly;

a drawer having bottom, front, rear, and side walls defining a drawer compartment, said front, rear, and side walls having upper edges forming an upwardly presented opening in said drawer compartment;

a lid shaped to fit in covering relation over said upwardly presented opening in said drawer compartment;

a guide mechanism mounting said drawer to said frame assembly for movement from a closed to an open position;

a spray assembly within said drawer compartment for spraying a washing fluid on objects within said drawer compartment;

a spray conduit connected to said frame assembly and positioned for fluid connection to said spray assembly whenever said drawer is in said closed position;

said spray conduit being disconnected from said drawer when said drawer moves from said closed position toward said open position.

7. A dishwasher comprising:

a support assembly;

a drawer having bottom, front, rear, and side walls defining a drawer compartment, said front, rear, and side walls having upper edges forming an upwardly presented opening;

a guide mechanism mounting said drawer to said support assembly for movement between a closed position and an open position;

a lid shaped to fit in covering relation over said upwardly presented opening of said drawer compartment;

lid mounting mechanism movably mounting said lid to said support assembly for movement between a lower position and an upper position;

a bias mechanism urging said lid toward said upper position;

said lid being in sealed covering relation over said upwardly presented opening of said drawer compartment when said drawer and said lid are in said closed position and said lower position respectively;

said lid moving upwardly away from said upwardly presented opening of said drawer compartment and toward said upper position in response to said urging of said bias mechanism when said drawer moves from said closed position to said open position;

a spray assembly within said drawer compartment for spraying washing fluid onto objects within said drawer compartment; and a washing fluid conduit connected to said lid and connected to said spray assembly for delivering washing fluid to said spray assembly.

8. A dishwasher according to claim 7, and further comprising a portion of said drawer engageable with said lid when said drawer moves from said open position to said closed position to cause said lid to move against the bias of said bias mechanism from said upper position to said lower position.

9. A dishwasher according to claim 7, and further comprising a drain opening in said drawer for draining said washing fluid from said drawer compartment, a drain conduit positioned to receive washing fluid from said drawer compartment through said drain opening.

10. A dishwasher according to claim 7, wherein said washing fluid conduit is fixed and a flexible coupling is connected between said washing fluid conduit and said spray assembly to maintain a flexing connection between said washing fluid conduit and said spray assembly during movement of said lid between said lower and said upper positions.

11. A drawer dishwasher comprising:

a frame;

a drawer having a bottom wall and a plurality of side walls forming a drawer compartment having an upwardly presented drawer opening, said side walls each having upper edges surrounding said upwardly presented opening;

a lid mounted to said frame and having lid edges adapted to register with said upper edges of said drawer;

said drawer being connected to said frame for movement from a retracted position spaced from said lid to a closed position wherein said upper edges of said drawer are in registered alignment below said lid edges;

a drawer spray mechanism within said drawer for spraying washing fluid on objects within said drawer;

a lid spray mechanism connected to said lid for spraying washing fluid on objects within said drawer when said drawer is in said closed position; and a seal member between said lid edges of said lid and said upper edges of said drawer and forming a fluid tight seal there between when said drawer is in said closed position.

12. A drawer dishwasher according to claim 11, wherein said lid is stationary.

13. A drawer dishwasher according to claim 12, wherein said seal member is inflatable from an uninflated position wherein said seal member does not form a fluid tight seal between said upper edges of said drawer to an inflated position wherein said seal member expands and forms a fluid tight seal therebetween.

14. A drawer dishwasher according to claim 11, wherein said drawer spray mechanism includes a drawer spray conduit having an inlet opening and a flexible gasket surrounding said inlet opening; said lid spray mechanism having a lid spray conduit with a fluid opening therein, said gasket of said drawer spray conduit registering with and forming a fluid seal around said fluid opening of said lid spray conduit when said drawer is in said closed position.

15. A dishwasher comprising:

a support assembly;

a drawer having bottom, front, rear, and side walls defining a drawer compartment, said front, rear, and side walls having upper edges forming an upwardly presented opening;

said upper edges of said side walls being inclined downwardly from said front wall to said rear wall;

a guide mechanism mounting said drawer to said support assembly for movement between a closed position and an open position;

a lid having a top wall, a front wall, a rear wall, and opposite side walls, and being wedge shaped with said rear wall having a vertical height greater than said front wall;

said lid being shaped to fit in sealed covering relation over said upwardly presented opening of said drawer compartment when said drawer is in said closed position;

lid mounting mechanism movably mounting said lid to said support assembly for movement between a lower position and an upper position;

a bias mechanism urging said lid toward said upper position;

said drawer contacting said lid when said drawer moves from said open to said closed position to move said lid from said upper position to said lower position, whereby said lid will be in said lower position and in sealed covering relation over said upwardly presented opening of said drawer compartment when said drawer is in said closed position; said drawer moving out of contact with said lid when said drawer moves from said closed to said open position, whereby said lid moves from said lower position to said upper position in response to said bias mechanism.

* * * * *